US006020854A

United States Patent [19]

Jagnow et al.

[11] Patent Number: 6,020,854

[45] Date of Patent: Feb. 1, 2000

[54] ARTILLERY FUSE ANTENNA FOR POSITIONING AND TELEMETRY

[75] Inventors: Paul G. Jagnow; William C. Jennings, both of Iowa City, Iowa

[73] Assignee: Rockwell Collins, Inc., Cedar Rapids, Iowa

[21] Appl. No.: 09/086,638

[22] Filed: May 29, 1998

[51] Int. Cl.[7] ..... H01Q 1/28; H01Q 9/00

[52] U.S. Cl. ..... 343/705; 343/752

[58] Field of Search ..... 343/705, 708, 343/749, 752, 830

[56] References Cited

U.S. PATENT DOCUMENTS

| | | | |
|---|---|---|---|
| 3,852,756 | 12/1974 | Reese | 343/708 |
| 3,967,276 | 6/1976 | Goubau | 343/752 |
| 4,037,540 | 7/1977 | Keydel | 343/708 |
| 5,652,598 | 7/1997 | Campbell et al. | 343/791 |
| 5,815,120 | 9/1998 | Lawrence et al. | 343/702 |

*Primary Examiner*—Don Wong
*Assistant Examiner*—Tan Ho
*Attorney, Agent, or Firm*—Kyle Eppele; James P. O'Shaughnessy

[57] ABSTRACT

An antenna for utilization in a fuse of an artillery shell is disclosed. The antenna comprises a radiator, a capacitance hat disposed at a first end of the radiator for capacitively loading the radiator and a ground plane disposed at a second end of the radiator such that the antenna is a monopole antenna. The antenna also includes a dielectric having a top surface, a bottom surface and a central longitudinal axis wherein the capacitance hat is disposed on the top surface of the dielectric and the ground plane is disposed on the bottom surface of the dielectric. A fuse utilized for detonating the explosive charge of an artillery shell is further disclosed. The fuse includes a fuse casing with the antenna of the present invention disposed within the interior cavity of the fuse casing.

14 Claims, 3 Drawing Sheets

ARTILLERY FUSE ANTENNA FOR POSITIONING AND TELEMETRY

FIELD OF THE INVENTION

The present invention generally relates to the field of artillery fuses, and particularly to an antenna for utilization in an artillery fuse.

BACKGROUND OF THE INVENTION

Artillery shells typically utilize a fuse installed at the leading end of the shell. The fuse is a mechanical or electronic device designed to control the detonation of the explosive charge of the shell. Modern artillery fuses further include electronics and telemetry systems for improved accuracy and detonation control. The electronic circuits disposed in the fuse remain in radio-frequency contact with a ground station after launch of the shell for coordinating the trajectory of the shell, making course correction as necessary. Further, the artillery fuse may operate in conjunction with a satellite based positioning system such as the NAVSTAR global positioning system (GPS), maintained and operated by the United States government, for accurately determining the coordinates of the shell as it travels along its trajectory and reaches the point of impact, and for correcting the trajectories of subsequently fired munitions.

An artillery fuse having telemetry and positioning system electronics requires an antenna suitable for the application and environment to which an artillery shell is subject. The fuse antenna should be able to survive the extreme acceleration and high rotational velocities typical of gun launched projectiles. Further, the radiation pattern of the antenna should exhibit relatively high gain in the aft direction, the direction opposite to the direction of travel of the shell. The radiation pattern of the antenna should be minimal in the direction of travel of the shell to minimize or prevent jamming from the vicinity of the target area of the shell. Such an antenna should be of a sufficiently reduced size so as not to occupy a large of space within the interior of the fuse, and is desirably designed for operation with L-band and S-band signals. ("L" is the letter designation for microwave signals in the frequency range from 1 to 2 GHz and "S" is the letter designation for microwave signals in the frequency range from 2–4 GHz.)

The performance of prior antenna configurations such as patch-array designs are subject to performance degradation effects including carrier-phase roll-up and roll-ripple due to antenna asymmetry. It would be desirable to provide an antenna having azimuthal symmetry to avoid such performance degrading problems. It would be further desirable to provide an antenna that does not require power combiners or impedance matching, and that does not suffer impedance loss typical with prior antenna implementations.

SUMMARY OF THE INVENTION

The present invention is directed to an antenna for utilization in a fuse of an artillery shell. In one embodiment, the antenna includes a radiator having first and second ends, a length and a diameter for radiating a radio-frequency signal, a capacitance hat disposed at the first end of the radiator for capacitively loading the radiator wherein the capacitance hat is symmetrically disposed with respect to the radiator, and a ground plane disposed at the second end of the radiator wherein the ground plane is symmetrically disposed with respect to the radiator such that the antenna is a monopole antenna. The antenna also includes a dielectric having a top surface, a bottom surface and a central longitudinal axis, the dielectric being symmetrically disposed about the central longitudinal axis wherein radiator is disposed coincidentally with the central longitudinal axis of the dielectric, the capacitance hat is disposed on the top surface of the dielectric and the ground plane is disposed on the bottom surface of the dielectric.

The present invention is also directed to a fuse utilized for detonating the explosive charge of an artillery shell. In one embodiment, the fuse includes a casing symmetrically disposed about a longitudinal central axis and defining an interior cavity, and the antenna of the present invention disposed within the interior cavity of the fuse casing.

It is to be understood that both the foregoing general description and the following detailed description are exemplary and explanatory only and are not restrictive of the invention as claimed.

The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiment of the invention, an example of which is illustrated in the accompanying drawings.

Figure 1:
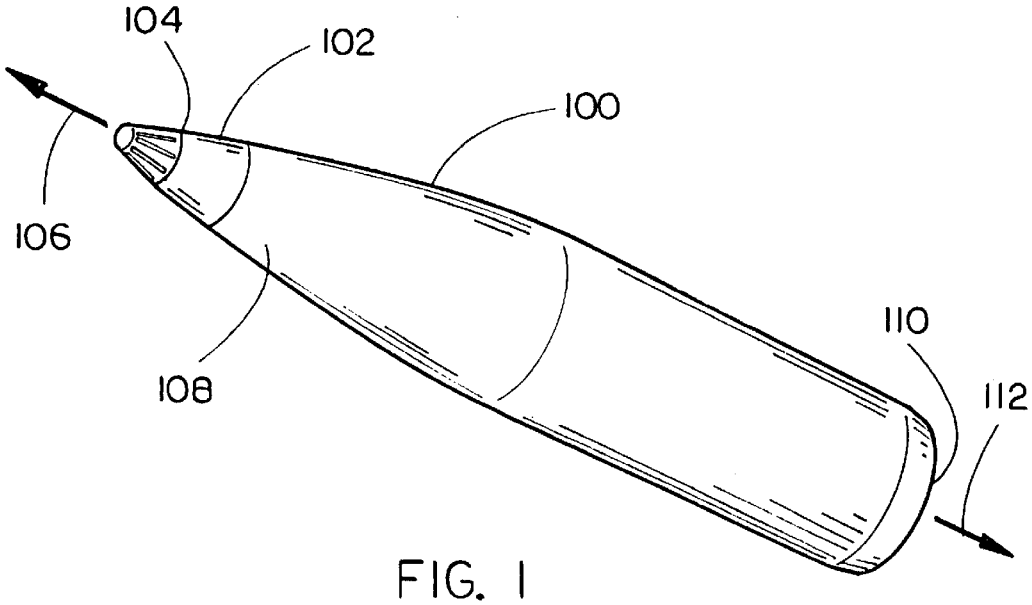
FIG. 1 is an illustration of an artillery shell in which the antenna of the present invention is utilized.

Referring now to FIG. 1, an artillery shell in accordance with the present invention is shown. The artillery shell 100 is typically launched or fired from a cannon, mortar, or similar type of gun (not shown). A fuse 104 is disposed at the nose 102 of shell 100 and is typically physically contiguous with the body of shell 100. A fuse, or fuze, is a mechanical or electronic device utilized for detonating an explosive charge such as the charge of an artillery shell or similar munition. Shell 100, when launched or otherwise projected, travels in a forward direction 106 toward the vicinity of a target. The rear 110 of shell 100 generally points in the aft direction 112 toward the vicinity of origin of shell 100, i.e. toward the gun from which shell 100 is launched.

Figure 2:
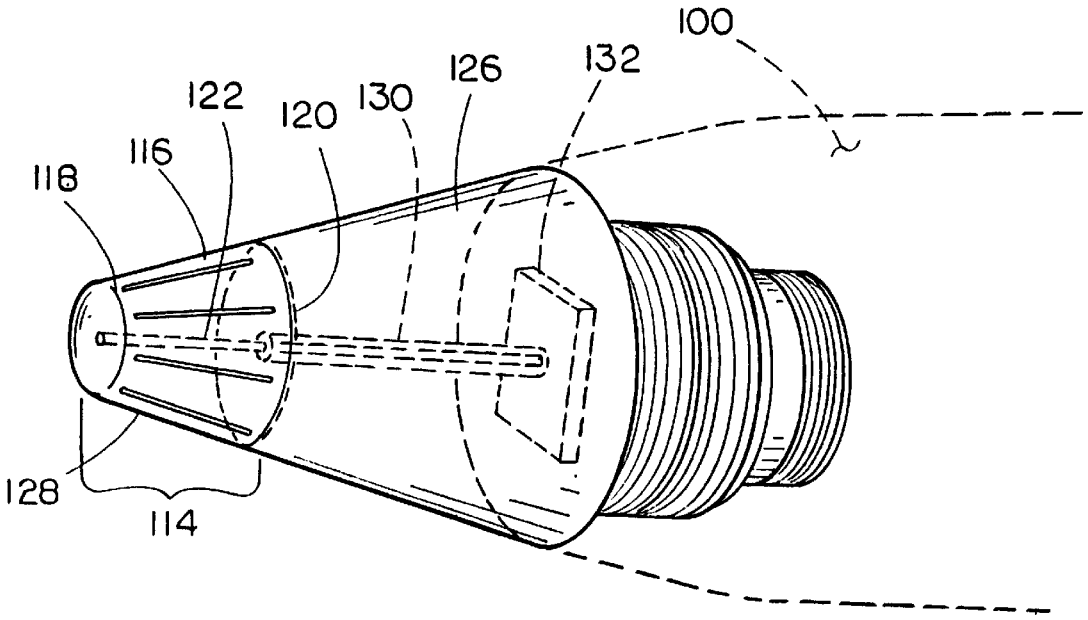
FIG. 2 is an illustration of the antenna of the present invention disposed in the nose of a fuse for an artillery shell.

Referring now to FIG. 2, an artillery shell fuse incorporating the antenna of the present invention is shown. The fuse 126 shown in FIG. 2 is analogous to fuse 104 shown in FIG. 1. Antenna 128 comprises a frustumularly shaped dielectric 116 having a top surface 118 and a bottom surface 120. A frustum is generally the part of a solid, such as a cone or pyramid, disposed between two usually parallel cutting planes. More specifically, a frustum is the part of a conical solid left after cutting off the top portion or vertex of the cone with a plane parallel to the base of the cone. A frustum is defined also to include any object, form, or shape symmetrically disposed about a longitudinal axis and having an outer surface definable by a line, by a conical section, or by a quadratic equation. Antenna 128 is disposed in the nose 114 of fuse 126. A radiator 122 is disposed coincidentally with the central axis of dielectric 116. Top surface 118 of dielectric 116 is metallized and electrically connected to radiator 122 to function as a capacitance hat for radiator 122. Further, bottom surface 120 of dielectric 116 is also metallized and functions as a ground plane for radiator 120. Since metallized bottom surface 120 functions as a ground plane, it is not electrically connected to radiator 122. Metallized bottom surface 120 has an aperture formed therein to allow radiator 122 or a conductor coupled to radiator 122 to pass therethrough. Thus, antenna 128 is a monopole antenna comprising a single radiator 122 having a capacitance hat 118 at the end of radiator 122. Normally, radiator 122 of antenna 128 must be of a length equal to one-quarter of the carrier wavelength for which antenna 128 is designed. However, capacitance hat 118 allows the length of radiator 122 to be less than one-quarter of the desired wavelength due to the effects of capacitive loading. The shorter length of radiator 122 allows the overall size of antenna to be correspondingly smaller as well, thereby facilitating the fit of antenna 128 into the nose 114 of fuse 126.

Capacitance hat 118 (metallized top surface 118 of dielectric 116) is used to implement capacitive loading of monopole radiator 122. The length of monopole radiator 122 is physically shorter than one-fourth the wavelength of the signal for which antenna 128 is designed. Capacitance hat 118 is disposed at the end of radiator 122 thereby capacitively loading radiator 122 and effectively tuning antenna 128 to be electrically equivalent to a non-capacitively loaded radiator having a length equal to one-quarter wavelength. Utilization of capacitance hat 118 allows for a shorter physical length of radiator 122 and therefore a reduction in the overall size of antenna 128. A reduction in the size of antenna 128 allows for antenna 128 to fit within a smaller sized fuse 126 without occupying a large amount of space. Further, capacitive loading of radiator 122 provides an increase in the bandwidth of antenna 128, thereby allowing antenna 128 to be utilized over a greater range of frequencies. The bandwidth of antenna 128 may also be determined by the diameter of radiator 122. The bandwidth of antenna 128 is proportional to the diameter of radiator 122; the greater the diameter of radiator 122, the greater the bandwidth of antenna 128.

In a preferred embodiment of the invention, antenna 128 comprises a monolithic structure capable of withstanding the dynamically harsh environment of accelerations greater than or equal to 35,000 g's (where 1 g is the acceleration caused by the earth's gravitational field at seal level) and roll rates greater than or equal to 21,000 rotations per second such as experienced by shell 100 during flight. The monopole design of antenna 128 is azimuthally symmetric, thereby providing immunity to carrier-phase roll-up and roll-ripple. Antenna 128 is mechanically robust, low volume, and low cost and does not require power combiners or impedance matching typically required on asymmetrical antenna designs. Consequently, antenna 128 does not suffer the additional power loss of antennas requiring power combiners or impedance matching. The impedance of antenna 128 is preferably approximately 50 ohms.

The length and diameter of radiator 122 determines the center frequency of antenna 128, and the material which dielectric 116 comprises determines the bandwidth of antenna 128. Antenna 128 is desirably adapted to operate at both L-band and S-band frequencies. The overall length of antenna 128 is preferably on the order of 0.75 inches or less. Antenna 128 preferably fits within the envelope of a standard fuse.

Antenna 128 couples to an electronic circuit 132 disposed in fuse 126 via a transmission line 130. Transmission line 130 preferably comprises a coaxial cable conductor. The center conductor of coaxial cable 130 electrically connects to radiator 122, and the outer shielding conductor of coaxial cable 130 electrically connects to ground plane 120 of antenna 128.

Figure 3:
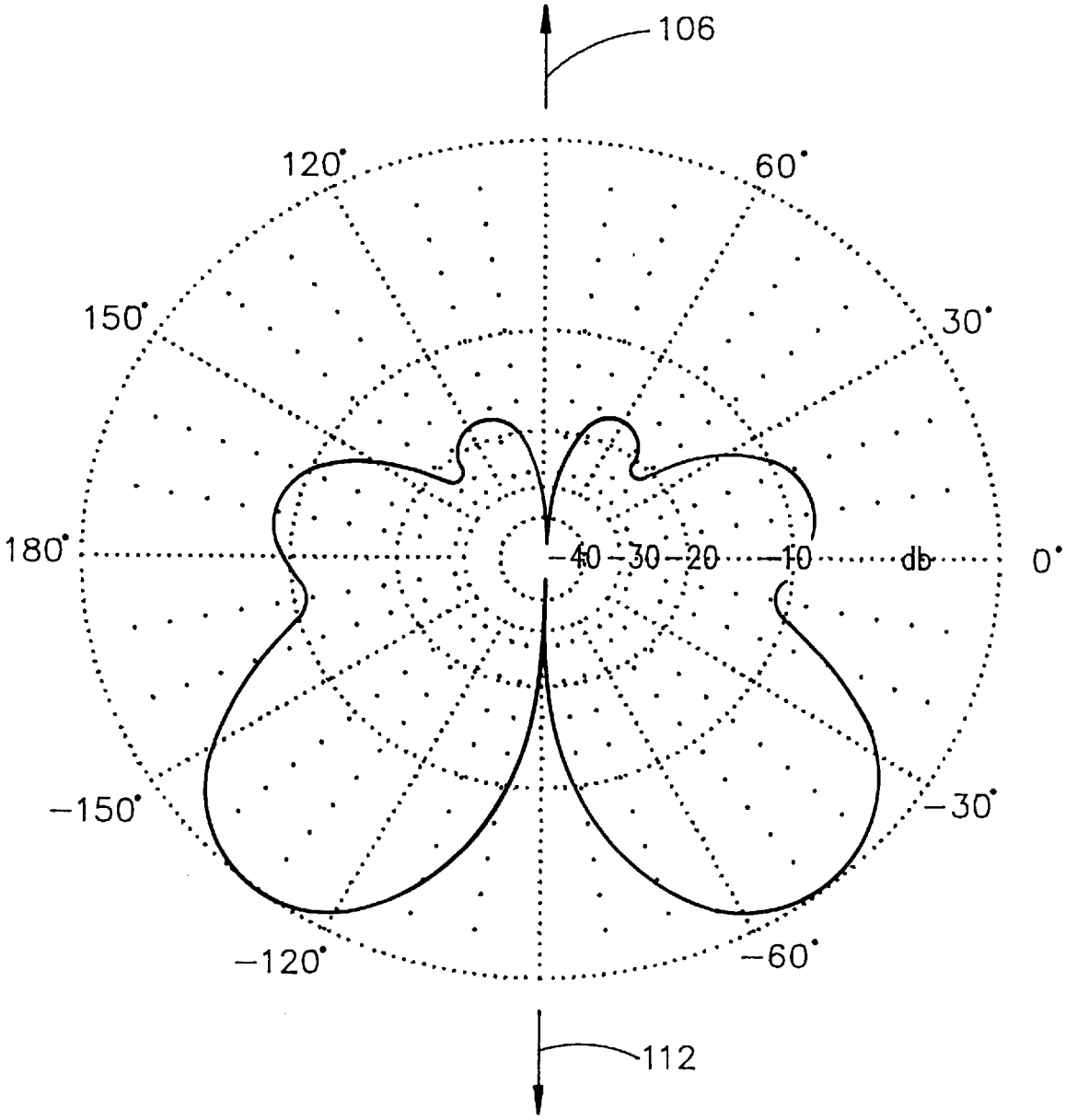
FIG. 3 is a graphical depiction of the radiation pattern of the antenna of the present invention.

Referring now to FIG. 3, the radiation pattern of the antenna of the present invention is shown. The radiation pattern of FIG. 3 represents the electric field radiation pattern of antenna 128 of FIG. 2 when transmitting or receiving a signal of a desired wavelength. The electric field strength characteristics between 0 degrees to 180 degrees in the positive direction (upper portion of radiation pattern) corresponds to the forward direction 106 of travel of artillery shell 100 as shown in FIG. 1, and the electric field strength characteristics between 0 to 180 degrees in the negative direction (lower portion of radiation pattern) corresponds to the aft direction 112 of artillery shell 100 as shown in FIG. 1. As can be determined from the radiation pattern of FIG, 3, antenna 128 has a relatively lower gain (greater attenuation) in the forward direction 106, and a relatively greater gain (lower attenuation) in the aft direction 112. This type of radiation pattern is desirable since communications with a base station located at the point of origin of artillery shell 100 are facilitated, while the susceptibility of antenna 128 to jamming with a signal transmitted from the target location of artillery shell 100 is reduced. The desirable radiation pattern of antenna 128 shown in FIG. 3 is further enhanced by the conductivity of the casings of fuse 126 and shell 100, whereby the radiation pattern is further "pulled" away from the forward direction 106 toward the aft direction 112. This results from the casings enhancing the effectiveness of ground plane 120.

Figure 4:
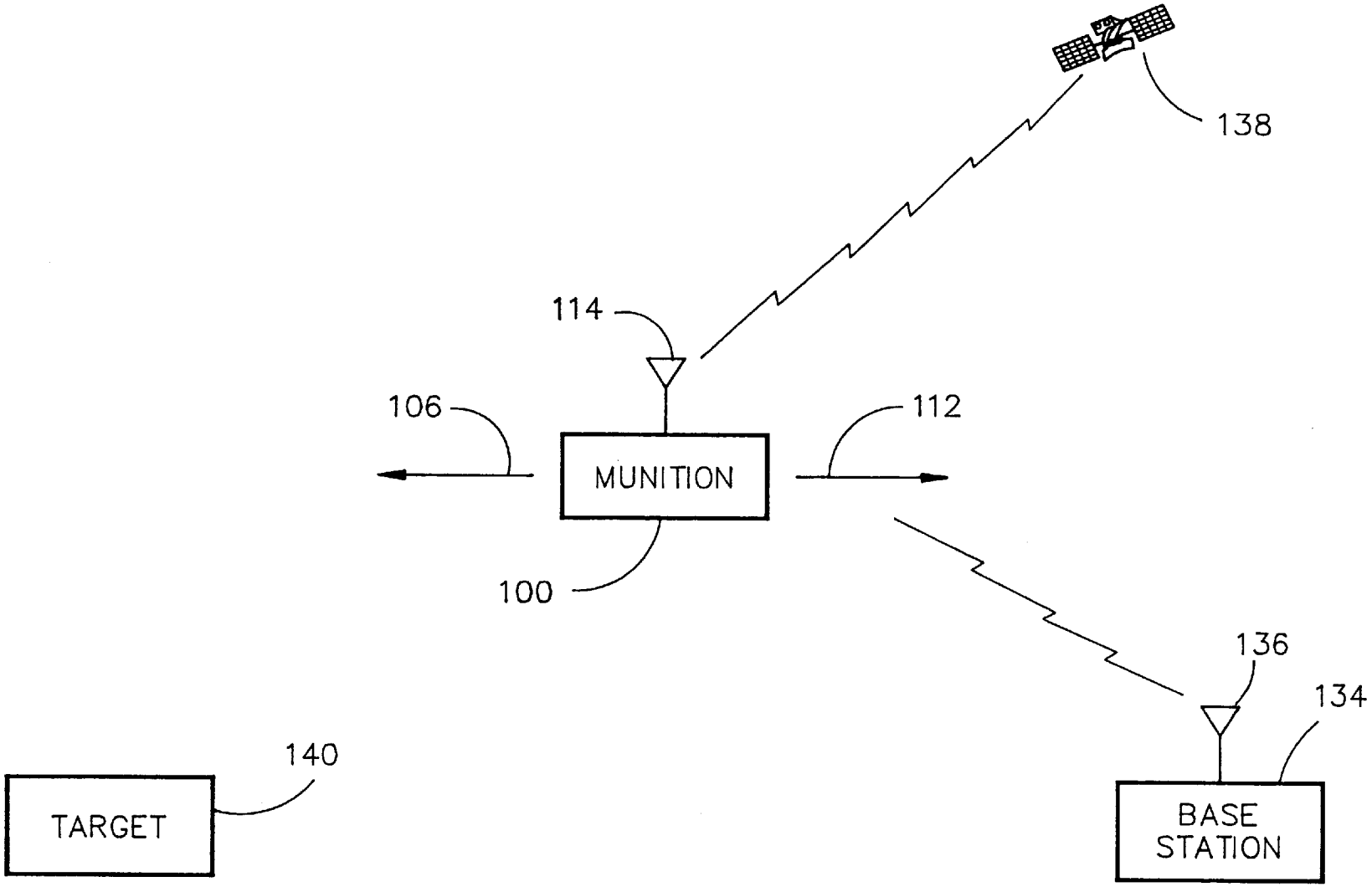
FIG. 4 is an illustration of a munitions telemetry system in which the antenna of the present invention may be utilized.

Referring now to FIG. 4, an application of the antenna of the present invention is shown. An artillery shell (munition) 100 is launched toward a target 140, travelling in a forward direction 106 toward target 140. A base station 134 is located within the vicinity of origin of shell 100 in an aft direction 112 from shell 100 with respect to the forward direction of travel 106 of shell 100. Antenna 128 facilitates transmission of a radio-frequency telemetry signal 142 between shell 100 and a remote device such as base station 134. Base station 134 is provided with an antenna 136 for facilitating radio-frequency communications between shell 100 and base station 134. Further, antenna 144 facilitates reception of a positioning signal 144 received from a space vehicle 138 as part of a constellation of space vehicles in a global positioning system. The positioning signal 144 allows for the instantaneous position and trajectory of shell 100 to be defined and integrated with the telemetry signal 142 such that base station 134 may coordinate the guiding of shell 100 toward target 140 and the detonating of fuse 126.

Space vehicle 138 may be a satellite in the NAVSTAR global positioning system (GPS) maintained and operated by the U.S. government. The GPS system comprises a constellation of earth orbiting space vehicles that continuously transmit telemetry signals that provide time and position information to a receiver capable of receiving and decoding the telemetry signals. Thus, electronics 132 of fuse 126 may include a GPS receiver such that the instantaneous position and trajectory of munition 100 may be determined. Further, electronics 132 may include a transmitter or transceiver which relays the GPS time and position information of munition 100 to base station 134 for range correction and auto-registration purposes. The signal relayed between artillery shell 100 and base station 134 may be a pseudo-lite GPS signal, for example. Thus, utilization of fuse 126 so equipped and utilizing the antenna of the present invention transforms artillery shell 100 into a competent munition.

It is believed that the artillery fuse antenna of the present invention and many of its attendant advantages will be understood by the foregoing description, and it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. An antenna for utilization in a fuse of an artillery shell, comprising:

a radiator having first and second ends, a length and a diameter for radiating a radio-frequency signal;

a capacitance hat disposed at the first end of said radiator for capacitively loading said radiator, said capacitance hat being symmetrically disposed with respect to said radiator; and a ground plane disposed at the second end of said radiator and being symmetrically disposed with respect to said radiator such that the antenna is a monopole antenna wherein said capacitance hat and said ground plane define a frustum having a central longitudinal axis coincidental with said radiator.

2. An antenna as claimed in claim 1, wherein the said radiator, said capacitance hat and said dielectric are optimized for operation of antenna in the L-band and the S-band.

3. An antenna for utilization in a fuse of an artillery shell, comprising:

a dielectric having a top surface, a bottom surface and a central longitudinal axis, said dielectric being symmetrically disposed about the central longitudinal axis;

a radiator having first and second ends, a length and a diameter for radiating a radio-frequency signal;

a capacitance hat disposed on the top surface of said dielectric and coupled to the first end of said radiator for capacitively loading said radiator;

a ground plane disposed on the bottom surface of said dielectric adjacent to the second end of said radiator such that the antenna is a monopole antenna.

4. An antenna as claimed in claim 3, wherein a said dielectric is frustumularly shaped.

5. An antenna as claimed in claim 3, wherein the top surface of said dielectric is discoidally shaped.

6. An antenna as claimed in claim 3, wherein the bottom surface of said dielectric is discoidally shaped.

7. An antenna as claimed in claim 3, wherein the length and diameter of said radiator and said capacitance hat are optimized for operation of the antenna in the L-band.

8. An antenna as claimed in claim 3, wherein the length and diameter of said radiator and said capacitance hat are optimized for operation of the antenna in the S-band.

9. A fuse utilized for detonating the explosive charge of an artillery shell, comprising:

a casing symmetrically disposed about a longitudinal central axis and defining an interior cavity; and an antenna for relaying a radio-frequency signal between the fuse and a remote device, said antenna comprising a radiator having first and second ends disposed within the interior cavity coincidentally with the longitudinal central axis, a capacitance hat disposed at the first end of said radiator for capacitively loading said radiator, and a ground plane disposed perpendicular to the longitudinal central axis at the second end of said radiator.

10. A fuse as claimed in claim 9, further comprising a transmitter coupled to said antenna for transmitting a radio-frequency signal from the fuse to the remote device.

11. A fuse as claimed in claim 9, further comprising a receiver coupled to said antenna for receiving a radio-frequency signal from the remote device.

12. A fuse as claimed in claim 9, wherein said antenna is frustumularly shaped.

13. A fuse as claimed in claim 9, wherein said casing increases the effectiveness of said ground plane.

14. A fuse as claimed in claim 9, wherein said antenna is optimized for operation with L-band and S-band signals.

* * * * *